United States Patent [19]

Oka et al.

[11] Patent Number: 4,510,229

[45] Date of Patent: Apr. 9, 1985

[54] LITHOGRAPHIC PHOTOSENSITIVE MATERIAL

[75] Inventors: Yutaka Oka; Naomi Saeki; Yoshiharu Fuseya, all of Kanagawa, Japan

[73] Assignee: Fuji Photo Film Co., Ltd., Kanagawa, Japan

[21] Appl. No.: 591,227

[22] Filed: Mar. 19, 1984

Related U.S. Application Data

[63] Continuation of Ser. No. 392,911, Jun. 28, 1982, abandoned.

[30] Foreign Application Priority Data

Jun. 26. 1981 [JP] Japan ..... 56-99194

[51] Int. Cl.[3] ..... G03C 1/06; G03C 5/24; G03C 1/02

[52] U.S. Cl. ..... 430/265; 430/264; 430/267; 430/441; 430/564; 430/599; 430/600; 430/603; 430/949

[58] Field of Search ..... 430/302, 305, 441, 607, 430/631

[56] References Cited

U.S. PATENT DOCUMENTS

| | | | |
|---|---|---|---|
| 2,362,598 | 11/1944 | Vittum et al. | 430/552 |
| 2,536,010 | 12/1950 | Schmidt et al. | 430/552 |
| 3,737,316 | 6/1973 | Salminen et al. | 430/472 |
| 3,790,383 | 2/1974 | Shimamura et al. | 430/265 |
| 3,799,780 | 3/1974 | Suga | 430/268 |
| 4,009,038 | 2/1977 | Arai et al. | 430/552 |
| 4,010,036 | 3/1977 | Suga et al. | 430/949 |
| 4,011,082 | 3/1977 | Sakai et al. | 430/949 |
| 4,311,781 | 1/1982 | Mifune et al. | 430/949 |
| 4,332,878 | 6/1982 | Akimura et al. | 430/264 |
| 4,358,532 | 11/1982 | Koyama et al. | 430/599 |
| 4,447,523 | 5/1984 | Ross et al. | 430/564 |

*Primary Examiner*—Mary F. Downey

*Attorney, Agent, or Firm*—Sughrue, Mion, Zinn, Macpeak and Seas

[57] ABSTRACT

A lithographic photosensitive material which comprises a support having thereon at least one silver halide emulsion layer and that, contains as a lithographic development accelerating agent a compound represented by the following general formula (I) in its silver halide emulsion layer or another hydrophilic colloidal layer:

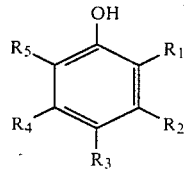

(I)

wherein $R_1$ to $R_5$ may be the same or different, and they each represent hydrogen, a halogen atom, an alkyl group, an alkoxy group, an aryl group,

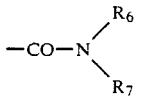

(wherein $R_6$ and $R_7$ each represents hydrogen or an alkyl group, or they may combine with each other to form a 5- or 6-membered nitrogen containing saturated hetero ring), —NH—CO—$R_8$ or —$NHSO_2$—$R_9$ (wherein $R_8$ and $R_9$ each represents an alkyl group, an aryl group or an aralkyl group), or $R_3$ and $R_4$, or $R_4$ and $R_5$ may combine with each other to form a benzene ring and that, it is necessary to said compound that at least one of substituents $R_1$, $R_3$ and $R_5$ represents —$NHSO_2$—$R_9$, or the benzene ring formed by combining $R_3$ and $R_4$, or by combining $R_4$ with $R_5$ is substituted with at least one —$NHSO_2$—$R_9$ group.

19 Claims, No Drawings

LITHOGRAPHIC PHOTOSENSITIVE MATERIAL

This application is a continuation of application Ser. No. 392,911, filed 6/28/82, now abandoned.

FIELD OF THE INVENTION

The present invention relates to a lithographic photosensitive material and particularly, to a lithographic photosensitive material (, which is abbreviated as a lith material hereinafter) which can provide the photographic characteristics that are almost independent of the kind of lith-developer used.

BACKGROUND OF THE INVENTION

A lith material is prepared by coating on a support a silver halide photographic emulsion having high contrast. When the material is processed with a special supercontrasy developing solution (, which is called a lith developer hereinafter), it produces a halftone dot or line image with very high contrast. The resultant material can be used as a photographic master for printing.

The term lith developer means a so-called infectious developer in which generally contains a dihydroxybenzene type developing agent and a sulfite as preservative in an amount controlled to about 5 g or less per 1 liter of the developer. During the development process the dihydroxybenzene type developing agent is successively activated and therethrough, development proceeds rapidly to produce an image with very high contrast.

Development of this kind suffers from the defect that it requires time to commence the blackening reaction (, that is, development proceeds slowly at the initial stage), or in contrast with this, at the final stage of development, though density of blackened area remains approximately constant, the image contrast begins to decrease resulting in deterioration of image quality, particularly quality of halftone dots.

It would be very beneficial to the graphic art to obtain sufficient high sensitivity and good image quality (, particularly high contrast and high blackening degree) at all times over a wide period of developing time from the initial stage to the final one of the development, by accelerating the developing speed at its initial stage and by preventing deterioration of image qualities at the final stage of development as much as possible. To obtain these results various accelerating agents for lithographic development have been proposed. For example, alkylamino compounds having arylureas incorporated in lith materials are known as effective accelerating agents for lithographic development. However, such known lithographic development accelerating agents are not desirable because they are slightly eluted from the lith materials in which they are incorporated. Accordingly, they accumulate little by little in the lith developer as the period of using the lith developer increases and cause variations in the sensitivities of lith materials to be processed latter. In view of this problem it has become desirable to determine compounds which exhibit a lithographic development accelerating effect without exhibiting the elution and accumulation phenomenon in the lith developer used.

Lith developers are presently divided broadly into two groups; one group includes those containing as preservatives diethanolamine or triethanolamine (, which are described using the general term amines hereinafter) and the other group includes those not containing such amines in addition to a conventionally used sulfite. Lith developers containing amines are described in, for example, U.S. Pat. Nos. 1,925,557; 2,388,816 and 3,573,914: published examined Japanese Patent Application No. 27346/71: and published unexamined Japanese Patent Application No. 39947/75. However, according to our finding, lith developers containing amines have a tendency to increase the apparent sensitivity, unlike the lith developers not containing amines. This finding implies that amines accelerate the development. This is not desirable because though the same lith materials are used, photographic characteristics attained are subject to variation according to the developer used, that is, whether it contains amines or not. In view of these problems it would be desirable to provide a lith material such that when the same materials are processed with different lith developers they always exhibit generally equal photographic characteristics, being independent of the presence of amines in the developer used.

SUMMARY OF THE INVENTION

An object of the present invention is to provide a lith material containing a novel lith development accelerating agent which can exert its development accelerating effect to a marked degree especially upon lith developers not containing amines.

A second object of the present invention is to provide a lith material containing a lith development accelerating agent which does not accumulate in the lith developer by the development-processing.

A third object of the present invention is to provide a lith material, the photographic characteristics of which are hardly influenced by if the lith developer used contains amines.

The above-described objects are achieved with a lithographic photosensitive material which comprises a support having thereon at least one silver halide emulsion layer, with the silver halide emulsion layer or the other hydrophilic colloidal layer containing a compound represented by the following general formula (I):

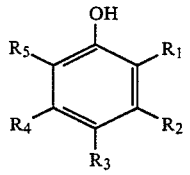

(I)

wherein $R_1$ to $R_5$ may be the same or different and they each represents hydrogen, a halogen atom, an alkyl group, an alkoxy group, an aryl group,

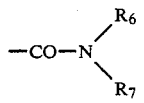

(wherein $R_6$ and $R_7$ each represents hydrogen or an alkyl group, or they may combine with each other and form a 5- or 6-membered nitrogen-containing saturated hetero ring), —NH—CO—$R_8$ or —$NHSO_2$—$R_9$ (wherein $R_8$ and $R_9$ each represents an alkyl group, an aryl group or an aralkyl group), or the substituents $R_3$ and $R_4$, or the substituents $R_4$ and $R_5$ may combine with each other to form a benzene ring and that, it is necessary to said compound that at least one of the substituents $R_1$, $R_3$ and $R_5$ represents —$NHSO_2$—$R_9$, or the benzene ring formed by combining $R_3$ with $R_4$ or combining $R_4$ with $R_5$ is substituted with at least one —$NHSO_2$—$R_9$ group.

DETAILED DESCRIPTION OF THE INVENTION

More specifically, halogen atoms represented by $R_1$ to $R_5$ in the general formula (I) include fluorine, chlorine, bromine and iodine. Suitable examples of the alkyl group represented by the substituents $R_1$ to $R_5$ include those having 1 to 5 carbon atoms, such as methyl, ethyl, n-propyl, i-propyl, n-butyl, t-butyl, n-pentyl, etc. Suitable examples of the alkoxy group represented by the substituents $R_1$ to $R_5$ include those having 1 to 6 carbon atoms, such as methoxy, ethoxy, n-butoxy, etc. Examples of the aryl group represented by the substituents $R_1$ to $R_5$ include those having 6 to 10 carbon atoms, such as phenyl, tollyl, naphthyl, etc. Preferable examples of the alkyl group represented by $R_6$ and $R_7$ in the group

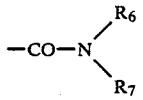

which the substituents $R_1$ to $R_5$ represent include those having 1 to 5 carbon atoms, such as methyl, ethyl and so on, and preferable examples of the nitrogen-containing saturated hetero ring which $R_6$ and $R_7$ form by combining with each other include a pyrrolidine ring, a perhydropyridine ring, a morpholine ring and the like. Preferable examples of the alkyl group represented by $R_8$ and $R_9$ in the group —NHCO—$R_8$ and the group —$NHSO_2$—$R_9$ respectively which the substituents $R_1$ to $R_5$ represent include those having 1 to 12 carbon atoms (e.g., methyl, ethyl, n-butyl, t-amyl, n-decyl and so on), and preferable examples of the aryl group represented by the substituents $R_8$ and $R_9$ include those having 6 to 18 carbon atoms, such as phenyl, naphthyl and these groups substituted with alkyl groups (, preferably those having 1 to 5 carbon atoms), alkoxy groups (, preferably those having 1 to 8 carbon atoms), halogen atoms (chlorine, bromine, etc.), nitro groups and/or carboxyl groups. Preferable examples of the aralkyl group represented by the substituents $R_8$ and $R_9$ include those having 7 to 18 carbon atoms, such as benzyl and so on.

Of the compounds represented by the general formula (I), those represented by the following general formula (II) are more advantageous in the present invention:

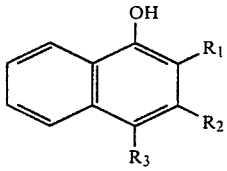

(II)

wherein $R_1$, $R_2$ and $R_3$ have the same meanings as in the general formula (I) respectively and that, at least one of these substituents must be —$NHSO_2$—$R_9$ (wherein $R_9$ has the same meaning as $R_9$ in the general formula (I)).

In the compounds represented by the general formula (I) and the general formula (II), those represented by the following general formula (III) are particularly preferable:

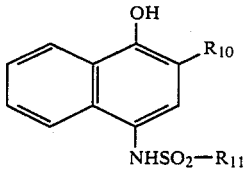

(III)

wherein $R_{10}$ represents hydrogen, a halogen atom or a group

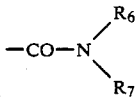

(wherein $R_6$ and $R_7$ have the same meanings as $R_6$ and $R_7$ in the general formula (I) respectively); and $R_{11}$ represents an aryl group, with preferable examples including a phenyl group, and a naphthyl group these groups substituted with alkyl groups (, preferably those having 1 to 5 carbon atoms), alkoxy groups (, preferably those having 1 to 8 carbon atoms), halogen atoms (chlorine, bromine, etc.), nitro groups and/or carboxyl groups.

Further, among the compounds represented by the general formula (I), the compound which contains at least one —$NHSO_2$—$R_9$, one alkoxy group and one alkyl group simultaneously as substituents of $R_1$ to $R_5$ is also preferred.

Specific examples of the compounds represented by the general formula (I) which can be preferably employed in the present invention are illustrated below.

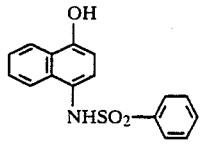

Compound 1

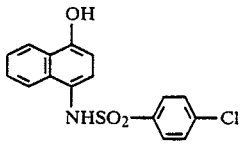

Compound 2

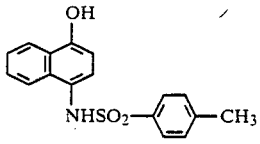

Compound 3

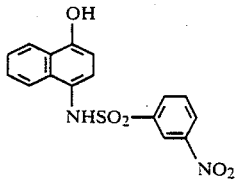

Compound 4

-continued

Compound 5

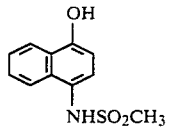

Compound 6

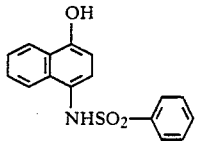

Compound 7

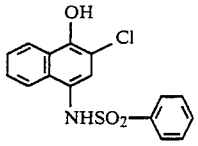

Compound 8

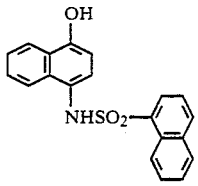

Compound 9

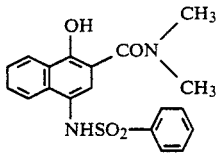

Compound 10

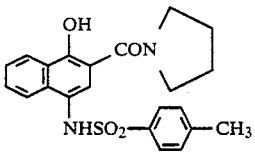

Compound 11

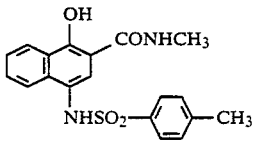

Compound 12

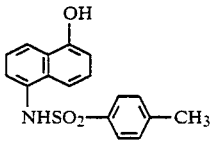

Compound 13

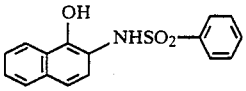

Compound 14

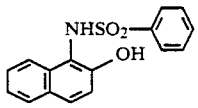

Compound 15

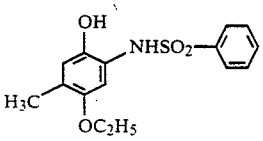

-continued

Compound 16

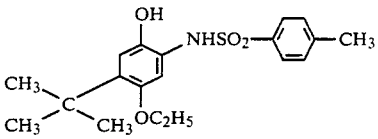

Compound 17

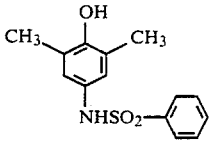

Compound 18

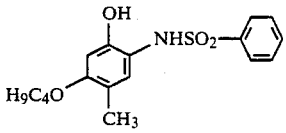

Compound 19

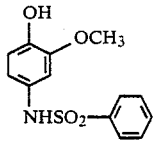

Compound 20

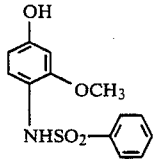

These compounds represented by the general formula (I) can be synthesized by condensing aminophenols or aminonaphthols and acyl halides or sulfonyl chloride(s) in the presence of a base like pyridine, as illustrated schematically below. In carrying out such a condensation reaction, descriptions in U.S. Pat. No. 3,737,316 (incorporated herein by reference to disclose how the compounds can be synthesized); and published unexamined Japanese Patent Application Nos. 36436/81 and 16452/81 can be referred to.

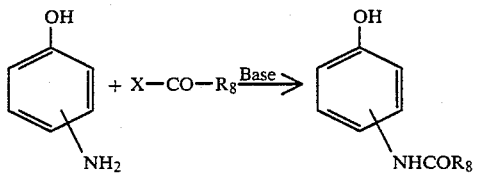

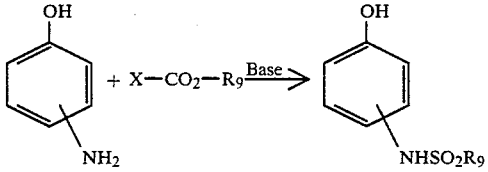

In the above-described reaction scheme, X represents halogen (e.g., chlorine).

Typical synthesis examples of the compounds of the present invention are illustrated in detail below. However, the compounds of the present invention, other than the illustrated ones, can be also synthesized in the similar manner.

SYNTHESIS EXAMPLE 1

Synthesis of Compound 1

To a mixture of 9.8 g (0.05 mol) of 4-amino-1-naphthol hydrochloride, 7.9 g (0.1 mol) of pyridine and 50 ml of dimethylacetoamide, was added dropwise a solution of 8.9 g (0.05 mol) of benzenesulfonyl chloride in dimethylacetoamide in a stream of nitrogen as the mixture was cooled in an ice bath. After 1 hour, the resulting solution was poured into 400 ml of water placed in a beaker. Thereupon, a glutinous matter separated out, and it was crystallized by a short stirring. This crystalline precipitate was recrystallized from a mixed solvent of water and ethanol. Thus, Compound 1 having a decomposition point of 201°-202° C. was obtained.

SYNTHESIS EXAMPLE 2

Synthesis of Compound 15

To a mixture of 8.4 g (0.05 mol) of 2-amino-4-ethoxy-5-methylphenol hydrochloride, 7.9 g (0.1 mol) of pyridine and 50 ml of dimethylacetoamide which was cooled in an ice bath, was added dropwise in a stream of nitrogen a solution of 8.9 g (0.05 mol) of benzenesulfonyl chloride dissolved in dimethylacetoamide. After 2 hours, the resulting solution was poured into water and thereupon, a crystalline precipitate was separated out. It was filtered off, and recrystallized from acetonitrile. Thus, Compound 15 having a melting point of 127°-128° C. was obtained.

In the present invention, the compound represented by the general formula (I) is preferably incorporated in a photosensitive material, particularly in its silver halide photographic emulsion layer and/or the layers adjacent thereto. Good results are obtained when it is added in the range of 1 mg to 1000 mg, particularly 10 mg to 100 mg, per 1 mol of silver halide.

The time for addition thereof is not subject to any particular restrictions. However, it is preferred for the addition to be carried out before the coating of the photographic layer and after the completion of the chemical ripening of the photographic emulsion.

Silver halide emulsions to be employed in the present invention can be prepared using a neutral process, an acid process, a single jet process, a double jet process, a controlled double jet process or so on, which are described in C.E.K. Mees, *The Theory of the Photographic Process,* 3rd Ed., pp. 31-43, McMillan, New York (1966), P. Grafikides, *Chimie Photographique,* 2nd Ed., pp. 251-308, Paul Montel, Paris (1957) and so on.

The present invention does not impose any special restrictions on the silver halide composition. However, suitable silver halides are silver chlorobromide or silver chloroiodobromide which each contains 0 to 50 mol%, particularly 10 to 50 mol %, of silver bromide. There are no particular restructions with respect to the crystal form, the crystal habit and the size distribution of silver halide grains. However, grains having grain sizes of 0.7$\mu$ or less, and grains of a monodisperse system are preferably employed.

The silver halide emulsions to be used in the photosensitive materials of the present invention can be sensitized with gold compounds such as chloroaurates, gold trichloride and the like; salts of noble metals such as rhodium, iridium and the like; sulfur compounds capable of producing silver sulfide when they react with silver salts; and reducing compounds such as stannous salts, amines and so on without being attended by coarsening of grains.

Examples of vehicles for the silver halides which can be used in the photosensitive materials of the present invention include gelatin, denatured gelatins, gelatin derivatives, and synthetic hydrophilic polymers.

Into the silver halide emulsion layers and other layers, polymer latexes comprising homo- or copolymers of alkylacrylates, alkylmethacrylates, acrylic acid, glycidylacrylate or/and the like, which are described in U.S. Pat. Nos. 3,411,911; 3,411,912; 3,142,568; 3,325,286 and 3,547,650: published examined Japanese Patent Application No. 5331/70: and so on, can be incorporated for the purposes of improvements upon the dimentional stability and film properties of the photosensitive material.

The photographic emulsion can contain as an antifogging agent not only 4-hydroxy-6-methyl-1,3,3a, 7-tetraazaindene, 3-methylbenzothiazole and 1-phenyl-5-mercaptotetrazole, but also various kinds of heterocyclic compounds, mercury-containing compounds, mercapto compounds and other compounds well known in the art, as described in published unexamined Japanese Patent Application Nos. 81024/74, 6306/75 and 19429/75, and U.S. Pat. No. 3,850,639.

The lith type silver halide emulsion of the present invention can be ortho- or panchromatically spectrally sensitized or supersensitized by using cyanine dyes such as cyanine, merocyanine, carbocyanine and the like independently, in combination thereof, or in combination with styryl dyes. For this purpose, sensitizing dyes described in published unexamined Japanese Patent Application Nos. 95836/76 and 18311/77, and U.S. Pat. No. 3,567,458 are especially suitable.

Hardening agents which can be used include, though no particular restrictions are placed thereon, aldehyde series compounds, ketone compounds, reactive halogen-containing compounds such as 2-hydroxy-4,6-dichloro-1,3,5-triazine and so on, reactive olefin-containing compounds, N-methylol compounds, aziridine compounds, carbodiimide compounds and so on.

To the photographic emulsions of the present invention, surface active agents can be added as a coating aid, or for other purposes, for example,,improvement in the photographic characteristics, and so on.

Examples of suitable surface active agents include natural surface active agents such as saponin; nonionic surface active agents of the alkyleneoxide type (e.g., surface active agents described in published unexamined Japanese Patent Application Nos. 156423/75 and 69124/74), glycidol type and so on; anionic surface active agents containing acid groups such as a carboxylic acid group, a sulfonic acid group (e.g., surface active agents described in U.S. Pat. No. 3,415,649), a phosphoric acid group, a sulfate group, a phosphate group and so on; and amphoteric surface active agents such as amino acids, aminosulfonic acids, the sulfates or the phosphates of aminoalcohols, and so on.

The lith materials of the present invention are developed with a developing solution containing sulfite ions in a low concentrations with the intention of improving the dot quality. When this is done, the incorporation of polyethylene oxide series compounds into their photosensitive layers will improve the dot qualities. Examples of these compounds include polyalkylene oxides and condensation products of polyethylene oxides with aliphatic alcohols, glycols, fatty acids, aliphatic amines, phenols, cyclodehydration products of hexitol derivatives, and so on. These compounds are described in U.S. Pat. Nos. 3,288,612; 3,345,175; 3,294,540 and 3,516,830: and so on, and specific examples thereof are illustrated below:

$HOCH_2CH_2O(CH_2CH_2O)_{50}CH_2CH_2OH$
$HOCH_2CH_2O(CH_2CH_2O)_{100}CH_2CH_2OH$ $$(CH_2)_{10}\begin{cases} O(CH_2CH_2O)_{10}CH_2CH_2OH \\ O(CH_2CH_2O)_{10}CH_2CH_2OH \end{cases}$$

$HOCH_2CH_2O(CH_2CH_2O)_{25}C_{17}H_{35}$ $$H(OCH_2CH_2)_a(OCH_2\underset{\underset{CH_3}{|}}{CH})_b(OCH_2CH_2)_cOH$$

$$\begin{pmatrix} a + c = 18 \\ b = 22 \end{pmatrix}$$

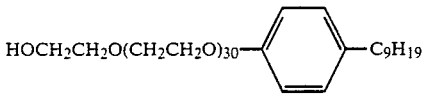

$H(OCH_2CH_2)_a(OCH_2CH_2CH_2CH_2)_b(OCH_2CH_2)_cOH$ $$\begin{pmatrix} a + c = 30 \\ b = 15 \end{pmatrix}$$

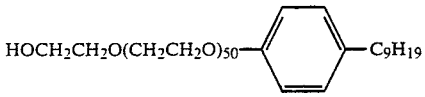

$HOCH_2CH_2(OCH_2CH_2)_{50}NHC_{12}H_{25}$
$HOCH_2CH_2O(CH_2CH_2O)_{40}CO(CH_2)_7CH{=}CHC_8H_{17}$

In addition, known development accelerators can be used together with the compounds represented by the general formula (I) of the present invention as the development accelerator in the present invention. Examples of known accelerators are described in U.S. Pat. Nos. 3,288,612; 3,333,959; 3,345,175 and 3,708,303: British Pat. No. 1,098,748: German Pat. Nos. 1,141,531 and 1,183,784: and so on.

For details of other additives for photographic emulsions, preparation processes of photosensitive materials and so on descriptions in *Product Lisencing Index,* vol. 92, pp. 107–110 (1971) can be referred to.

In the present invention, the photographic emulsion is coated on a flexible support which does not cause any appreciable dimentional change during the photographic processing, for example, a cellulose acetate film, a polyethylene terephthalate film, a polycarbonate film, a polystyrene film or the like.

In the present invention, the exposure for obtaining a photographic image may be carried out in a conventional manner used in the art. That is, a tungsten lamp, a carbon arc lamp, a mercury lamp, a luminescent lamp, a xenon arc lamp, a xenon flash lamp, cathode-ray tube flying spot, glow tube, laser beams (e.g., argon laser), luminescent diode and so on can be employed for the exposure. Suitable exposure times which can be used include not only usual exposure times ranging from several decades to about 1/1000 sec., but also exposure times shorter than 1/1000 sec., for example, about $1/10^4$ to about $1/10^6$. The spectral distribution of the light employed for the exposure can be controlled using color filters, if desired.

The lith developer employed in the present invention is constituted basically with an ortho- or a para-dihydroxybenzene, an alkali agent, a small amount of free sulfite and a sulfurous acid ion buffer. An ortho- or a para-dihydroxybenzene to be used as a developing agent can be properly chosen from compounds well known in the photographic art. Suitable examples thereof include hydroquinone, chlorohydroquinone, bromohydroquinone, isopropylhydroquinone, toluhydroquinone, methylhydroquinone, 2,3-dichlorohydroquinone, 2,5-dimethylhydroquinone and the like. Among these hydroquinones, hydroquinone is the most advantageous developing agent from the practical point of view. These developing agents may be used independently or in a mixed form. A suitable amount of the developing agent to be added is from 1 to 100 grams, preferably 5 to 80 grams, per liter of the developer. A sulfurous ion buffer is used in an amount effective for maintaining the sulfite concentration in the developer approximately constant, and specific examples thereof include adducts of aldehydes and hydrogensulfites of alkali metals, such as the adduct of formaldehyde and sodium hydrogensulfite and the like; adducts of ketones and hydrogensulfites of alkali metals, such as the adduct of acetone and sodium hydrogensulfite and the like; carbonylbisulfite-amine condensation products, such as sodium-bis(2-hydroxyethyl)aminomethanesulfonate and the like; and so on. A suitable amount of the sulfurous ion buffer to be added ranges from 13 to 130 grams per 1 liter of the developer.

In order to adjust the pH of the developer to not lower than 9 (preferably, 9.7 to 11.5), alkali agents are added. Sodium carbonate, potassium carbonate and the like are used as the alkali agents.

Free sulfurous acid ion concentration in the developer to be used in the present invention can be controlled by adding an alkali salt of sulfurous acid like sodium sulfite. A suitable amount of the sulfite is generally 5 grams or less, particularly 3 grams or less, per 1 liter of the developer. Of course, it does not matter if the addition amount is not less than 5 grams.

In many cases, an alkali halide (, particularly bromides such as sodium bromide and potassium bromide) is desirably contained as a development modifier in the developer. A suitable amount of the alkali halide to be added is 0.01 to 10 grams, preferably 0.1 to 5 grams, per 1 liter of the developer.

The developer to be employed in the present invention can contain, in addition to the above-described components, pH buffers such as water soluble acids (e.g., acetic acid, boric acid, etc.), alkalis (e.g., sodium hydroxide) and salts (e.g., sodium carbonate) as the need arises. Certain alkalis can not only render the developer alkaline but also act as a pH buffer and a development modifier. Other components which can be added to the developer include an antifoggant such as benzotriazole or 1-phenyl-5-mercaptotetrazole, an organic solvent such as triethylene glycol, dimethylformamide or methanol, and so on.

Further, amines like diethanolamine may be added as a preservative to the developer. The lith materials of the present invention can all alike attain intended photographic characteristics independently of the presence of amines in the developer used. In addition to amines, ascorbic acid and kojic acid can be also used as a preservative.

The developer may contain all of the abovedescribed components at the time of use, and before use, the developer may be preserved by dividing its composition into two or more of parts. For example, the composition is divided into the developing agent dissolved part and the alkali containing part, and both parts are mixed and diluted immediately before use.

In the present invention, the lith materials are preferably processed using an automatic conveyance type developing machine. No special restrictions are put on a means for conveyance and therefore, any conveyance type (e.g., roller conveyance, belt conveyance, etc.) automatic developing machine usually used in the art can be employed. Further, for details of developer compositions and developing processes descriptions in U.S. Pat. Nos. 3,025,779; 3,078,024; 3,122,086; 3,149,551; 3,156,173; 3,224,356 and 3,573,914: and so on can be referred to.

On the occasion that the lithographic photosensitive materials of the present invention are processed with a lithographic developer using an automatic conveyance type developing machine, the developing temperature is desirably adjusted to 20° to 50° C., particularly to 25 to 40° C., and the developing time is preferably set to 10 to 250 sec., particularly to 10 to 150 sec. No particular restrictions are put on fixing, washing and drying conditions and therefore, generally used conditions in the art can also be employed in the present invention.

EXAMPLE 1

A silver chlorobromide gelatin emulsion which contained 80 mol % of silver chloride and 20 mol % of silver bromide and received a chemical ripening treatment was made.

A 100 g portion of this emulsion was weighed in every six pots and to each, were added 3-carboxymethyl-5-[2-(3-ethyl-thiazolinidene)ethylidene]rhodanine, 4-hydroxy-6-methyl-1,3,3a,7-tetraazaindene, 1-phenylmercaptotetrazole, polyoxyethylene (containing 50 ethylene oxide moieties) allyl ether and mucochloric acid. Then, Compound 1 of the present invention was added in amounts set forth in Table 1 to the six pots, respectively. The thus obtained emulsions were each coated on a polyethylene terephthalate support having an antihalation layer on its back side at a coverage of 4.0 g silver per 1 $m^2$ of coated film to obtain samples 1 to 6.

Each of these six kinds of samples was wedgewise exposed to light from a tungsten light source through a 150-line gray contact screen, and development-processed with the lith developer having the following composition at a temperature of 27° C. for 1 min. and 40 sec., followed by a stop treatment and a fixing treatment in this order in conventional manners.

| Formula A of Lith Developer: | |
|---|---|
| Hydroquinone | 15 g |
| Sodium Formaldehyde Sulfite | 50 g |
| Potassium Carbonate | 30 g |
| Sodium Sulfite | 2 g |
| Potassium Bromide | 3 g |
| Boric Acid | 4 g |
| Sodium Hydroxide | 4 g |
| Triethylene Glycol | 40 g |
| Water to make | 1 l |

Results obtained are shown in Table 1.

TABLE 1

| Sample No. | Amount of Compound 1 Added (mg/mole of silver halide) | Relative Sensitivity* |
|---|---|---|
| 1 | 0 | 100 |
| 2 | 6.3 | 135 |
| 3 | 12.5 | 120 |
| 4 | 25.0 | 145 |
| 5 | 50.0 | 195 |
| 6 | 94.0 | 220 |

*expressed in the terms of logarithm of the reciprocal of the exposure required for obtaining an optical density of 1.5, and shown as relative values of Sample No. 1 as 100.

It is apparent from Table 1 that the compound represented by the general formula (I) of the present invention has a lith development accelerating effect. In addition, each of samples No. 2 to No. 6 was excellent in dot quality.

EXAMPLE 2

Samples No. 7 to No. 11 were prepared in the same manner as in Example 1 except that compounds described in Table 2 were employed instead of Compound 1, respectively. Each of the samples was divided into two portions, and exposed to light in the same manner as in Example 1. Thereafter, one portion of each sample was development-processed with the lith developer of the formula A described in Example 1 at 27° C. for 1 min and 40 sec., and the other portion of each sample was development-processed with the lith developer of formula B in which 20 g of diethanolamine was contained in addition to the composition of the lith developer A at 27° C. for 1 min and 40 sec. Then, the resultant samples were each subjected in sequence to stopping and fixing steps in a conventional manner, and their photographic characteristics were examined. The results obtained are shown in Table 2.

TABLE 2

| Sample No. | Amount of Compound Added (mg/mol of silver halide) | Relative Sensitivity | | Fog | | Dot Quality* | | Accumulation in Developer | |
|---|---|---|---|---|---|---|---|---|---|
| | | A | B | A | B | A | B | A | B |
| 7 | — | 14 | 42 | 0.04 | 0.04 | 4 | 3 | Not occur | Not occur |
| 8 | Compound 4 (40) | 85 | 100 | 0.04 | 0.04 | 1 | 1 | Not occur | Not occur |
| 9 | Compound 9 (32) | 105 | 98 | 0.04 | 0.04 | 1 | 1 | Not occur | Not occur |
| 10 | Compound 15 (32) | 102 | 110 | 0.04 | 0.04 | 1 | 1 | Not occur | Not occur |
| 11 | Reference Compound a | 50 | 78 | 0.04 | 0.04 | 2 | 1 | Occur | Occur |

TABLE 2-continued

| Sample No. | Amount of Compound Added (mg/mol of silver halide) | Relative Sensitivity A | Relative Sensitivity B | Fog A | Fog B | Dot Quality* A | Dot Quality* B | Accumulation in Developer A | Accumulation in Developer B |
|---|---|---|---|---|---|---|---|---|---|
| | (24) | | | | | | | | |

*For the evaluation of dot quality, 50% dot was observed, and ranked on the basis of visual judgement. A grade of "1" refers to a dot quality wherein halftone dots are sharply separated (i.e., without occurence of fringe); a grade of "2" refers to a dot quality wherein fringes slightly occur and lith materials which exhibit such dot quality can be put in practice as for ordinal one; a grade of "3" refers to a dot quality wherein fringes remarkably occur and lith materials which exhibit such dot quality have some problems even for low-grade one; and a grade of "4" refers to a dot quality having many fringes and a photographic materials which exhibit such dot quality cannot be put in practice at all.

Reference Compound a

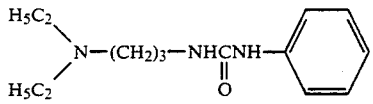

As can be seen from Table 2, as for the lith materials using the compounds of the present invention, the sensitivity each material exhibited when processed with the developer free from amines is slightly different from the sensitivity it exhibited when processed with the developer containing amines.

In order to make the above-described conclusions clear, ratios of the sensitivity each material exhibited when processed with the developer A based on the sensitivity it exhibited when processed with the developer B were respectively calculated with respect to each sample and shown in the following Table 3.

TABLE 3

| Sample No. | Sensitivity with Developer A/ Sensitivity with Developer B | Remarks |
|---|---|---|
| 7 | 33/100 | Black |
| 8 | 85/100 | The present Invention |
| 9 | 107/100 | The present Invention |
| 10 | 92/100 | The present Invention |
| 11 | 64/100 | Comparison |

As is apparent from the results shown in Table 3, the difference between the sensitivity each material exhibited when processed with the developer A and the sensitivity it exhibited when processed with the developer B with respect to the samples of the present invention was remarkably smaller than that with respect to the blank sample and furthermore it was considerably smaller than that with respect to the comparison sample containing a known lith development accelerating agent. This is believed to be ascribable to an effect wherein the compounds of the present invention very selectively accelerate lith development only in case of using the lith developer free from amins.

As is clear from the results shown in Table 2, the dot quality of Sample 11 which contains a known lith development accelerating agent was somewhat deteriorated, when it was processed with the lith developer free from amines, but the dot quality of the samples which each contains the compounds of the present invention was excellent even if they were processed with the lith developer free from amines. Further, as it apparent from the results shown in Table 2, a known lith development accelerating agent was dissolved into certain developer and accumulated therein to give rise to above-described defects, but the compounds of the present invention were not dissolved into certain developer and were not accumulated therein not to give rise to such defects at all.

While the invention has been described in detail and with reference to specific embodiments thereof, it will be apparent to one skilled in the art that various changes and modifications can be made therein without departing from the spirit and scope thereof.

what is claimed is:

1. A lithographic photosensitive material to provide high contrast half-tone dot or line silver images as final images for use in the graphic arts comprising:

a support base;

a silver halide emulsion layer containing silver chlorobromide or silver chloroiodobromide, each containing up to 50 mol% silver bromide, and developed by a lithographic developer comprising a o- or p-dihydroxybenzene developing agent; and a compound represented by the formula by the general formula (1):

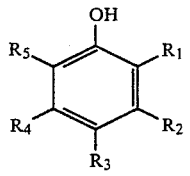

wherein $R_1$ to $R_5$ may be the same or different, and each represents hydrogen, a halogen atom, an alkyl group, an alkoxy group, an aryl group,

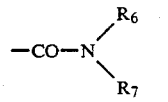

wherein $R_6$ and $R_7$ each represents hydrogen or an alkyl group, or they may combine with each other to form a 5- or 6-membered nitrogen containing saturated hetero ring, —NH—CO—$R_8$ or —$NHSO_2$—$R_9$ wherein $R_8$ and $R_9$ each represents an alkyl group, an aryl group or an aralkyl group, or $R_3$ and $R_4$, or $R_4$ and $R_5$ may combine with each other to form a benzene ring and that, it is necessary to said compound that one and only one of substituents $R_1$, $R_3$ and $R_5$ represents —$NHSO_2$—$R_9$, or the benzene ring formed by combining $R_3$ with $R_4$, or by combining $R_4$ with $R_5$ is substituted with at least one —$NHSO_2$—$R_9$ group.

2. A lithographic photosensitive material as claimed in claim 1, wherein the compound represented by general formula (I) is a compound selected from the group consisting of compounds represented by the general formula (II):

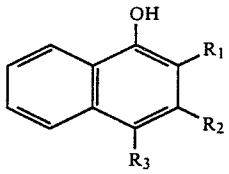

(II)

wherein $R_1$, $R_2$ and $R_3$ may be the same or different, and they each represents hydrogen, a halogen atom, an alkyl group, an alkoxy group, an aryl group,

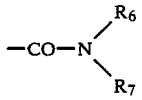

wherein $R_6$ and $R_7$ each represents hydrogen or an alkyl group, or they may combine with each other and form a 5- or 6-membered nitrogen-containing saturated hetero ring, —NH—CO—$R_8$ or —$NHSO_2$—$R_9$ wherein $R_8$ and $R_9$ each represents an alkyl group or an aralkyl group, and that, at least one of these substituents must be —$NHSO_2$—$R_9$ wherein $R_9$ represents an alkyl group or an aralkyl group.

3. A lithographic photosensitive material, as claimed in claim 1, wherein the compound represented by general formula (I) is a compound selected from the group of compounds represented by the general formula (III):

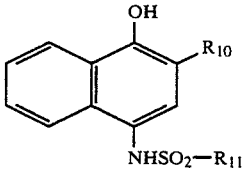

(III)

wherein $R_{10}$ represents hydrogen, a halogen atom or a group

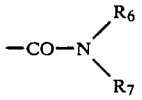

wherein $R_6$ and $R_7$ each represents hydrogen or an alkyl group, or they may combine with each other to form a 5- or 6-membered nitrogen containing saturated hetero ring and $R_{11}$ represents an aryl group.

4. A lithographic photosensitive material as claimed in claim 1, wherein the compound represented by general formula (I) is a compound which contains at least one —$NHSO_2$—$R_9$ wherein $R_9$ represents an alkyl group or aralkyl group, one alkoxy group and one alkyl group simultaneously as substituents of $R_1$ to $R_5$.

5. A lithographic photosensitive material, as claimed in claim 3, wherein the compound represented by the general formula (III) is present in an amount in the range of 1 mg to 1000 mg per 1 mol of silver halide.

6. A lithographic photosensitive material, as claimed in claim 5, wherein the compound represented by the general formula (III) is present in an amount in the range of 10 mg to 100 mg per 1 mol of silver halide.

7. A lithographic photosensitive material, as claimed in claim 3, wherein said $R_{11}$ aryl group is an unsubstituted or substituted phenyl group or naphthyl group.

8. A lithographic photosensitive material, as claimed in claim 7, wherein $R_{11}$ is a substituted phenyl group or naphthyl group wherein said substituent is at least one of an alkyl group, alkoxy group, halogen atom, nitro group or carboxyl group.

9. A lithographic photosensitive material, as claimed in claim 8, wherein said alkyl group substituent has 1 to 5 carbon atoms, said alkoxy group substituent has 1 to 8 carbon atoms and said halogen atom is chlorine or bromine.

10. A process for forming high contrast halftone dot or line silver images as final images for use in the graphic arts, comprising:

providing a lithographic photosensitive material comprising (a) a support base, (b) a silver halide emulsion layer containing silver chlorobromide or silver chloroiodobromide, each containing up to 50 mol% silver bromide, and developed by a lithographic developer comprising an o- or p-dihydroxybenzene developing agent, and (c) a compound represented by the general formula (I)

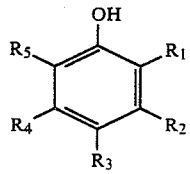

wherein $R_1$ to $R_5$ may be the same or different, and each represents hydrogen, a halogen atom, an alkyl group, an alkoxy group, an aryl group,

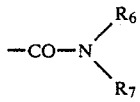

wherein $R_6$ and $R_7$ each represents hydrogen or an alkyl group, or they may combine with each other to form a 5- or 6-membered nitrogen containing saturated hetero ring, —NH—CO—$R_8$ or —$NHSO_2$—$R_9$ wherein $R_8$ and $R_9$ each represents an alkyl group, an aryl group or an aralkyl group, or $R_3$ and $R_4$, or $R_4$ and $R_5$ may combine with each other to form a benzene ring and that, it is necessary to said compound that one and only one of the substituents $R_1$, $R_3$ and $R_5$ represents —$NHSO_2$—$R_9$, or the benzene ring formed by combining $R_3$ with $R_4$, or by combining $R_4$ with $R_5$ is substituted with at least one —$NHSO_2$—$R_9$ group;

image-wise exposing the lithographic photosensitive material; and developing the exposed lithographic photosensitive material with a lithographic developer comprising an o- or p-dihydroxybenzene developing agent.

11. Process according to claim 10, wherein the compound represented by general formula (I) is a compound selected from the group consisting of compounds represented by the general formula (II)

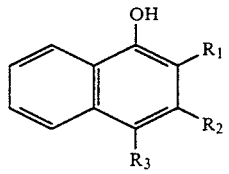

(II)

wherein $R_1$, $R_2$ and $R_3$ may be the same or different, and they each represent hydrogen, a halogen atom, an alkyl group, an alkoxy group, an aryl group,

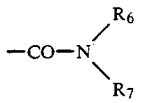

wherein $R_6$ and $R_7$ each represents hydrogen or an alkyl group, or they may combine with each other and form a 5- or 6-membered nitrogen-containing saturated hetero ring, —NH—CO—$R_8$ or —$NHSO_2$—$R_9$ wherein $R_8$ and $R_9$ each represents an alkyl group or an aralkyl group, and that, at least one of these substituents must be —$NHSO_2$—$R_9$ wherein $R_9$ represents an alkyl group or an aralykl group.

12. Process according to claim 10, wherein the compound represented by general formula (I) is a compound selected from the group of compounds represented by the general formula (III):

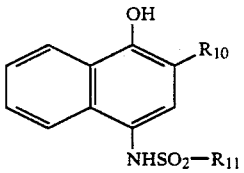

(III)

wherein $R_{10}$ represents hydrogen, a halogen atom or a group

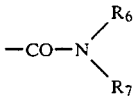

wherein $R_6$ and $R_7$ each represents hydrogen or an alkyl group, or they may combine with each other to form a 5- or 6-membered nitrogen-containing saturated hetero ring and $R_{11}$ represents an aryl group.

13. Process according to claim 10, wherein the compound represented by general formula (I) is a compound which contains at least one —$NHSO_2$—$R_9$ wherein $R_9$ represents an alkyl group or aralkyl group, one alkoxy group and one alkyl group simultaneously as substituents of $R_1$ to $R_5$.

14. Process according to claim 12, wherein the compound represented by the general formula (III) is present in an amount in the range of 1 mg to 1000 mg per 1 mol of silver halide.

15. Process according to claim 14, wherein the compound represented by the general formula (III) is present in an amount in the range of 10 mg to 100 mg per mol of silver halide.

16. Process according to claim 12, wherein said $R_{11}$ aryl group is an unsubstituted or substituted phenyl group or naphthyl group.

17. Process according to claim 16, wherein $R_{11}$ is a substituted phenyl group or naphthyl group wherein said substituent is at least one of an alkyl group, alkoxy group, halogen atom, nitro group or carboxyl group.

18. Process according to claim 17, wherein said alkyl group substituent has 1 to 5 carbon atoms, said alkoxy group substituent has 1 to 8 carbon atoms and said halogen atom is chlorine or bromine.

19. Process according to claim 10, wherein the lith-developer contains a sulfite as preservative in an amount of about 5 g or less per one liter of the developer.

* * * * *